United States Patent [19]

Park

[11] Patent Number: 4,757,173

[45] Date of Patent: Jul. 12, 1988

[54] TURNTABLE FOR USE IN A MICROWAVE OVEN

[75] Inventor: Jong K. Park, Kyungsangnam-Do, Rep. of Korea

[73] Assignee: Gold Star Co., Ltd., Seoul, Rep. of Korea

[21] Appl. No.: 55,056

[22] Filed: May 28, 1987

[51] Int. Cl.[4] ..... H05B 6/78

[52] U.S. Cl. ..... 219/10.55 F; 219/10.55 E

[58] Field of Search ..... 219/10.55 F, 10.55 E, 219/10.55 R; 108/20, 139, 138; 126/338; 99/443 R

[56] References Cited

U.S. PATENT DOCUMENTS 3,436,506 4/1969 Smith ..... 219/10.55 F 4,631,379 12/1986 Aoyama ..... 219/10.55 E

FOREIGN PATENT DOCUMENTS 223956 11/1968 U.S.S.R. ..... 219/10.55 F

*Primary Examiner*—Philip H. Leung

*Attorney, Agent, or Firm*—Birch, Stewart, Kolasch & Birch

[57] ABSTRACT

A turntable for use in a microwave oven which comprises a tray containing a stem portion for supporting an object to be heated, an axial cavity disposed in the stem portion, a motor shaft extending into the axial cavity for operative engagement with the stem portion, a motor connected to the motor shaft for rotating the shaft and tray and stem composite, a roller cavity disposed in the stem portion lateral to the axial cavity, and a roller eccentrically mounted in the roller cavity to support the stem portion whereby, upon the horizontal rotation of the stem and tray composite, the stem and tray also move in the vertical plane.

9 Claims, 2 Drawing Sheets

TURNTABLE FOR USE IN A MICROWAVE OVEN

BACKGROUND AND SUMMARY OF THE INVENTION

1. Field of the Invention

The present invention relates to an up-and-down turntable for use in a microwave oven, and more particularly, a turntable which enables to be moved up and down during its rotation for uniformly heating the cooking object.

2. Description of the Prior Art

In a conventional art, a microwave oven as shown in FIG. 1 contains a turntable which, during its rotation, is moved up and down to heat the cooking object although the heat cannot heat the cooking object uniformly.

The conventional turntable 1' as shown in FIG. 1 is operatively disposed in an annular holder 11' of a bottom plate 10'. An annular cam member 6' disposed in a case 3' includes a gear 8' disposed thereon and an inclined cam face 6''. The case 3' is provided with a motor 2' of which a shaft 2a is coaxially mounted with a super gear 9' which gears together with the gear 8' of the cam member 6' which is adapted to receive an axle 7' disposed therein.

According to the prior art (FIG. 1) the turntable is driven for rotation by the super gear 9' which is mounted coaxially with the shaft 2a' of the motor 2'. And the rotation of the super gear 9' is caused to rotate the cam member 6' by gearing together with the gear 8' and also to rotate the turntable which is operatively connected to the cam member 6'.

The inclined cam face 6'' disposed on the bottom surface of the cam member 6' operatively contacts with a roller 12', therefore, the rotating turntable 1' is moved up and down the distance between the dotted line position and the solid line position as shown in FIG. 1.

However, the conventional turntable is required many components since the mechanism of the up-and-down movement of the turntable in rotation becomes complicated. Furthermore, since the cam face 6'' has a fixed, inclined configuration, the cam face limits the up-and-down movement of the turntable. Therefore, the microwave applies only in a limited portion of the cooking object.

SUMMARY OF THE INVENTION

Accordingly, the present invention relates to a turntable which includes a tray supporting an object to be heated and a motor which is directly coupled to each other and a roller revolving on the surface of a case floor, attached to the tray for rotating, and rocking sideways the tray while the turntable moves up and down.

DETAILED DESCRIPTION OF THE INVENTION

Figure 1:
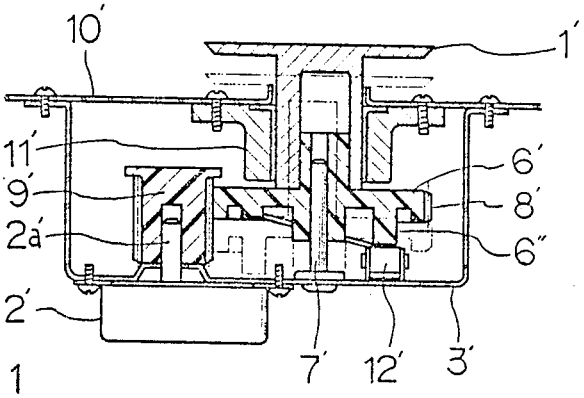
FIG. 1 PRIOR ART
FIG. 1 is a sectional view of a turntable of a conventional art.
Figure 2:
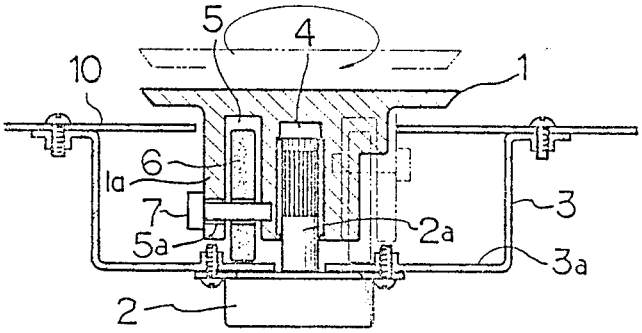
FIG. 2 is a sectional view of a turntable of the present invention.

Referring now in detail to the drawings for the purpose of illustrating preferred embodiment of the present invention, as shown in, FIG. 2 the turntable of the present includes a rotating tray 1 provided with an annular holder 11 disposed in a bottom plate 10 which is adapted to be operatively mounted to a stem portion 1a extended from the tray 1. The stem portion 1a includes a cavity 4 disposed along its center thereof for being adapted to receive a shaft 7 extended from the motor 2. A case 3 fixed to the bottom plate 10 has a motor 2 attached thereto, which includes a shaft 2a thereof so as to rotate and move up and down the tray 1 during the rotation of the motor 2. The tray 1 is provided with a recess 5 disposed in one side thereof large enough to receive a disc roller 6 having a pin hole 6a for being slidably received a pin 7 therewithin through an aperture 5a disposed in a rotatable axle 1a.

Figure 3:
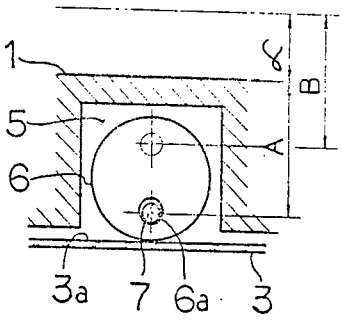
FIG. 3 is a cross-sectional view of a roller of the present showing a clearance during its vertical operation.

The pin hole 6a of the roller 6 is formed a larger diameter than a diameter of the pin 7 and is located at an eccentric position disposed on the disc roller 6 as shown in FIG. 3. The rotation of the tray 1 driven by the motor 2 operates within a differential height $\alpha$ between an upper and lower dead centers A and B during the up-and-down movement of the disc roller 6.

Figure 4:
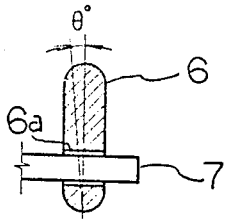
FIG. 4 is a sectional and enlarged view of the roller the present invention showing a width during its rocking sideways operation.

According to the enlarged section view of the roller 6 as shown in FIG. 4, the roller 6 has a Disc-shaped configuration with its rounded edges and is provided with the pin hole 6a disposed at an eccentric position for being adapted to slidably receive the pin 7. Also the pin 7 passes away in the aperture 5a disposed in the stem portion 1a so that the roller 6 rocks sideways in an angle $\theta$ in the recess 5 disposed in the tray 1 and maintains, in rocking sideways, the horizontal balance of the tray 1 in the same angle $\theta$.

In the present invention, while the tray 1 is horizontally rotated by the rotation of the motor causing the roller 6 to make it roll along the surface of a case floor 3a.

Therefore, the rotation of the roller 6 from the lower dead center A to the upper dead center B, in turn, from the upper dead center B to the lower dead center A gives a differential height $\alpha$ so that the continual rotation of the roller 6 is a reciprocating motion in the range of the distance $\alpha$ along with the same up-and-down movement of the rotating tray 1.

Besides, the tray 1 in the up-and-down movement rocks sideways in the angle $\theta$ since the roller 6 rocks sideways in the angle $\theta$.

Figure 5:
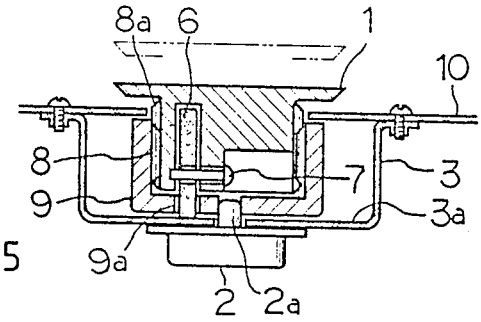
FIG. 5 a sectional view illustrating another embodiment of the present invention.

According to another embodiment of the present invention as shown in FIG. 5, the tray 1 is provide with a gear 8a' at its lower portion, that is, at the stem portion 1a for gearing together with a housing gear 8 disposed in an inner wall of a housing 9. The structure of the device as shown in FIG. 5 is so constructed that the tray is rocked during its rotation horizontally and simultaneously vertically. The drive power from the motor 2 is spreadably transmitted to the tray 1 through the gear 8 to the housing gear 8a. The rotation of the tray 1 and the roller 6 with the eccentrically positioned pin 7 is to cause the up-and-down movement of the tray along with the rocking movement of the roller 6 for bringing forth a better application of the microwave to the object on the tray.

As shown above, the construction of the present invention, wherein the motor is directly coupled to the tray which contains the roller being arranged to roll on the surface of case floor at the eccentric position so as to not only simplify but also readily facilitate the assembling process.

In addition, the clearance of the pin hole gives a side rocking of the roller in the angle $\theta$ which, in turn, rocks the tray with cooking objects in horizontally rotation and in vertically up-and-down movement for achieving the uniform heat to the object to be cooked.

What is claimed is

1. A turntable for use in a microwave oven which comprises:
   - a tray for supporting an object to be heated, said tray containing a stem portion,
   - an axial cavity disposed in said stem portion,
   - a motor shaft extending into said axial cavity for operative engagement with said stem portion,
   - motor means connected to said motor shaft for rotating said motor shaft and said tray and stem portion composite,
   - a roller cavity disposed in said stem portion lateral to said axial cavity, and
   - roller means eccentrically mounted in said roller cavity to support said stem portion whereby, upon the horizontal rotation of the stem portion and tray composite, the stem portion and tray also move in the vertical plane for subjecting the object to uniform heating in the microwave oven.

2. The turntable of claim 1, wherein the roller cavity contains lateral space on both sides of the roller means, said lateral space permitting lateral movement of the roller means whereby the tray and stem portion composite becomes canted during its rotation for exposing a larger surface of the object to be heated by microwave energy.

3. The turntable of claim 2, wherein the roller means is mounted with lateral clearance on a roller shaft for further causing the stem portion and tray composite to become additionally canted.

4. The turntable of claim 1 wherein the turntable is adapted to be disposed within a case which is mounted to a bottom plate of a microwave oven.

5. A turntable for use in a microwave oven which comprises:
   - a tray for supporting an object to be heated, said tray containing a stem portion,
   - a housing gear operatively engaged with the external surface of said stem portion,
   - motor means connected to said housing gear for rotating said housing gear and said stem portion and tray composite,
   - a roller cavity disposed in said stem portion lateral thereto, and
   - roller means eccentrically mounted in said roller cavity to support said stem portion whereby, upon the horizontal rotation of the stem portion and tray composite, the stem portion and tray also move in the vertical plane for subjecting the object to uniform heating in the microwave oven.

6. The turntable of claim 5, wherein the roller cavity contains lateral space on both sides of the roller means, said lateral space permitting lateral movement of the roller means whereby the tray and stem portion composite becomes canted during its rotation for exposing a larger surface of the object to be heated by microwave energy.

7. The turntable of claim 5, wherein the roller means is mounted with lateral clearance on a roller shaft for further causing the stem portion and tray composite to become additionally canted.

8. The turntable of claim 5 wherein the turntable is adapted to be disposed within a case which is mounted to a bottom plate of a microwave oven.

9. The turntable of claim 5, wherein the housing and the external surface of said stem portion are provided with gearing surfaces for engaging each other.

* * * * *